US006844806B1

(12) United States Patent
Lehmann

(10) Patent No.: US 6,844,806 B1
(45) Date of Patent: Jan. 18, 2005

(54) HIGH VOLTAGE LOAD RESISTOR ARRAY

(75) Inventor: Monty Ray Lehmann, Smithfield, VA (US)

(73) Assignee: Southeastern Universities Research Assn., Inc., Newport News, VA (US)

( * ) Notice: Subject to any disclaimer, the term of this patent is extended or adjusted under 35 U.S.C. 154(b) by 1 day.

(21) Appl. No.: 10/788,796

(22) Filed: Feb. 27, 2004

(51) Int. Cl.[7] ..... H01C 10/02
(52) U.S. Cl. ..... 338/80; 338/320; 338/319
(58) Field of Search ..... 338/80, 84, 319, 338/320; 361/122

*Primary Examiner*—Karl D. Easthom

(57) ABSTRACT

A high voltage resistor comprising an array of a plurality of parallel electrically connected resistor elements each containing a resistive solution, attached at each end thereof to an end plate, and about the circumference of each of the end plates, a corona reduction ring. Each of the resistor elements comprises an insulating tube having an electrode inserted into each end thereof and held in position by one or more hose clamps about the outer periphery of the insulating tube. According to a preferred embodiment, the electrode is fabricated from stainless steel and has a mushroom shape at one end, that inserted into the tube, and a flat end for engagement with the end plates that provides connection of the resistor array and with a load.

10 Claims, 4 Drawing Sheets

HIGH VOLTAGE LOAD RESISTOR ARRAY

The United States of America may have certain rights to this invention under Management and Operating Contract No. DE-AC05-84ER 40150 from the Department of Energy.

FIELD OF THE INVENTION

The present invention relates to high voltage resistors and more particularly to such a high voltage resistor that is capable of handling upwards of 600,000 volts DC at a current of 2 amps or more without arcing or surface breakdown.

BACKGROUND OF THE INVENTION

In certain leading edge technological applications such as the operation of free electron lasers and the like, there exists the need to be able to safely handle very high voltages, on the order of above 500,000 volts, in, for example, power supplies and the like. In such applications, load resistors capable of handling such voltages are a necessary requirement. In such applications, the presence of electrical current on the order of 2 amps or higher is also quite possible.

Currently there are only a few commercially available options for resistors capable of handling such loads. Among these are solid carbon resistors and high resistance metal alloy load banks. While solid carbon resistors are capable of handling such loads, they are very expensive to construct, require long lead times to obtain, are not adjustable to ohmic values other than those for which they were designed and built, i. e. not flexible, and if high voltage flash-over or arcing occurs significant damage will be inflicted and the costly resistor will have to be replaced because repair is not normally an option. Metal alloy banks demonstrate similar shortcomings in that they are even more expensive to construct, require long lead times to obtain, are not adjustable to ohmic values other than those for which they were designed and built and furthermore, are usually designed to handle larger current loads at much lower operating voltages than those encountered in, for example, the operation of free electron lasers as just described. Thus, while such prior art devices may meet the needs of certain applications, their high cost, relative inflexibility in terms of modification for load variation, and their relative inability to be readily repaired make them inappropriate for use in high voltage applications that may require voltage or amperage handling variation and could result in damage to the resistor.

Thus, there exists a need for a relatively inexpensive resistor system capable of handling very high voltages on the order of hundreds of thousands of volts, which resistor system possesses the ability to be readily modified to change is voltage/amperage handling characteristics and which can be readily repaired in the case of high voltage flash-over or arcing event.

OBJECTS OF THE INVENTION

It is therefore an object of the present invention to provide a high voltage resistor system that is relatively inexpensive to produce and which can be readily modified to alter its voltage/amperage handling capabilities.

It is another object of the present invention to provide a high voltage resistor system that, in the case of voltage flash-over or arcing or other damaging failure can be readily repaired at low cost.

SUMMARY OF THE INVENTION

According to the present invention there is provided a high voltage resistor comprising an array of a plurality of parallel electrically connected resistor elements each containing a resistive solution, attached at each end thereof to an end plate, and about the circumference of each of the end plates, a corona reduction ring. Each of the resistor elements comprises an insulating tube having an electrode inserted into each end thereof and held in position by one or more hose clamps about the outer periphery of the insulating tube. According to a preferred embodiment, the electrode is fabricated from stainless steel and has a mushroom shape at one end, that inserted into the tube, and a flat end for engagement with the end plates that provides connection of the resistor array and with a load.

DETAILED DESCRIPTION

Figure 1:
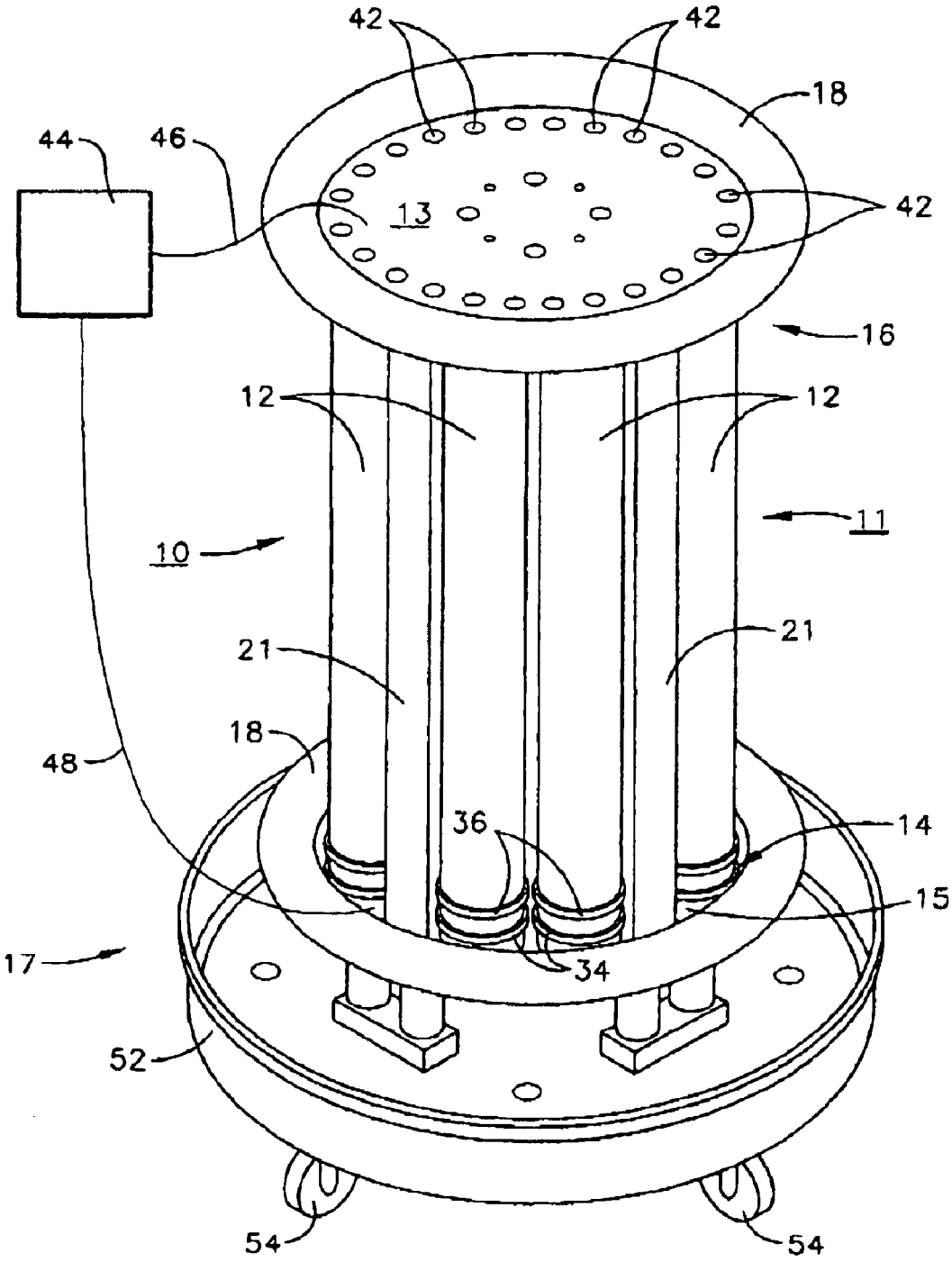
FIG. 1 is a perspective view of the resistor array of the present invention.
Figure 2:
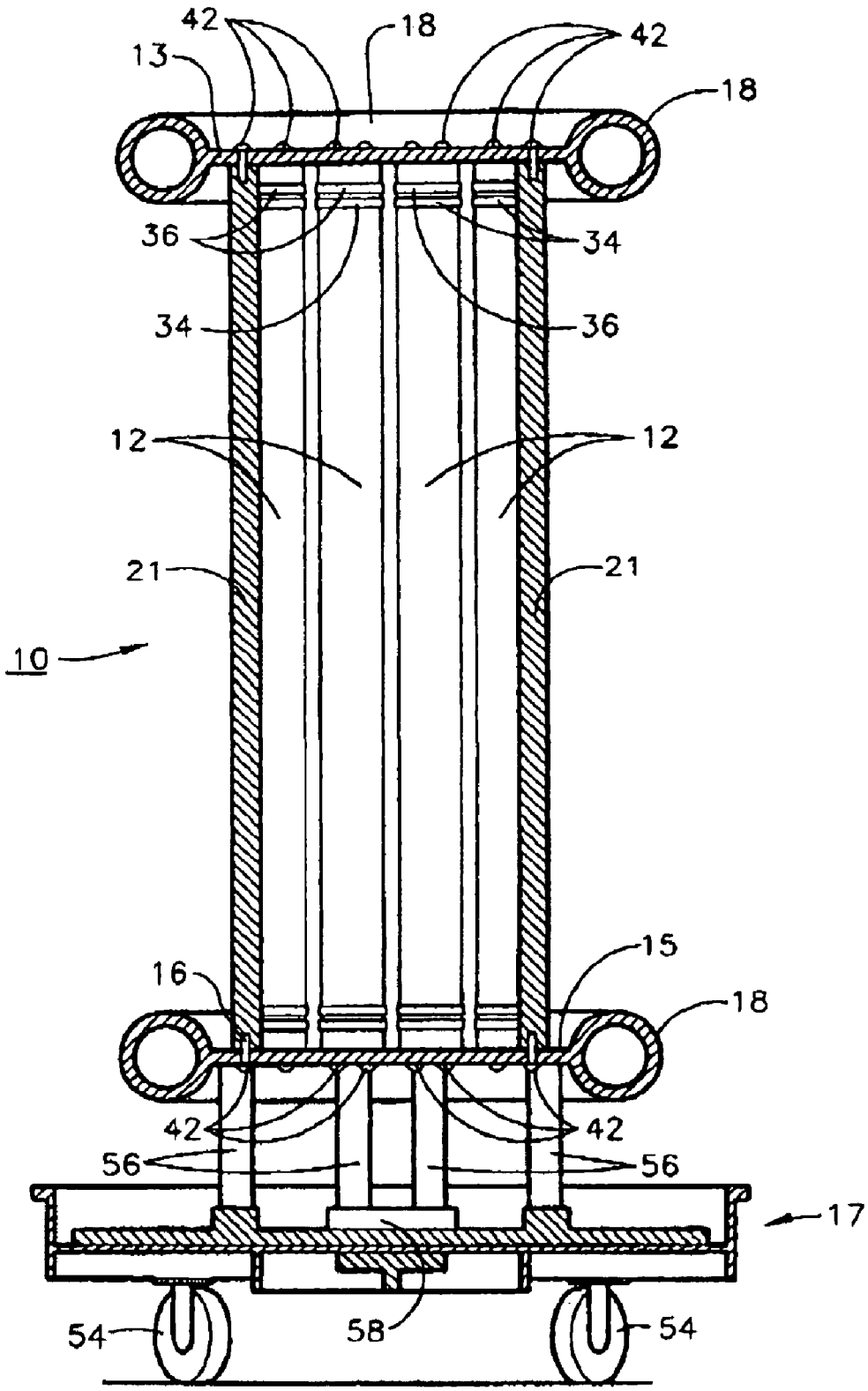
FIG. 2 is a cross sectional view of one embodiment of the resistor array of the present invention.

Referring now to the accompanying figures, the resistor array 10 of the present invention comprises an array of resistor elements 12 which array has first and second ends 14 and 16. Located about ends 14 and 16 are corona rings 18 that serve to protect resistor array 10 from damage by reducing the possibility of arcing or voltage flash-over. Each of resistor elements 12 is contactingly attached to end plates 13 and 15 as described below. Bottom end plate 15 is in turn preferably attached to a carriage 17 for ease of movement of resistor array 10 from location to location.

Corona rings 18 serve to minimize the possibility that any sharp edges on end plates 13 and 15 (described below) would emit corona in the case of a high voltage application resulting in arcing or voltage flash over and preferably form an integral part of end plates 13 and 15 (described below). Corona rings 18 must be of a size adequate to provide a required safety margin in the case of any potential arcing or voltage flash over. In the case of a resistor array 10 designed to handle on the order of 600 KV, corona rings on the order of 3 inches in diameter are generally adequate while end plates 13 and 15 are of a diameter of about 14 inches. In addition to protecting against corona discharge, corona rings 18 help to grad the electric fields evenly between end plates 13 and 15 thus reducing the chances of a high voltage arc over from high voltage input cable 46 to bottom end plate 15 or the ground plane end of resistor array 10. In the situation where resistor array 10 was exposed to an applied voltage of one Megavolt or more, corona rings 18 would have to be enlarged to on the order of 6 inches in diameter to facilitate electric field grading between end plates 13 and 15 and to provide the required arcing protection. While corona rings 18 are diepicted in the accompanying figures as integral portions of end plates 13 and 15, it will be readily understood that corona rings 18 could also be welded or otherwise attached to end plates 13 and 15 so as to render them integral parts of end plates 13 and 15.

Figure 3:
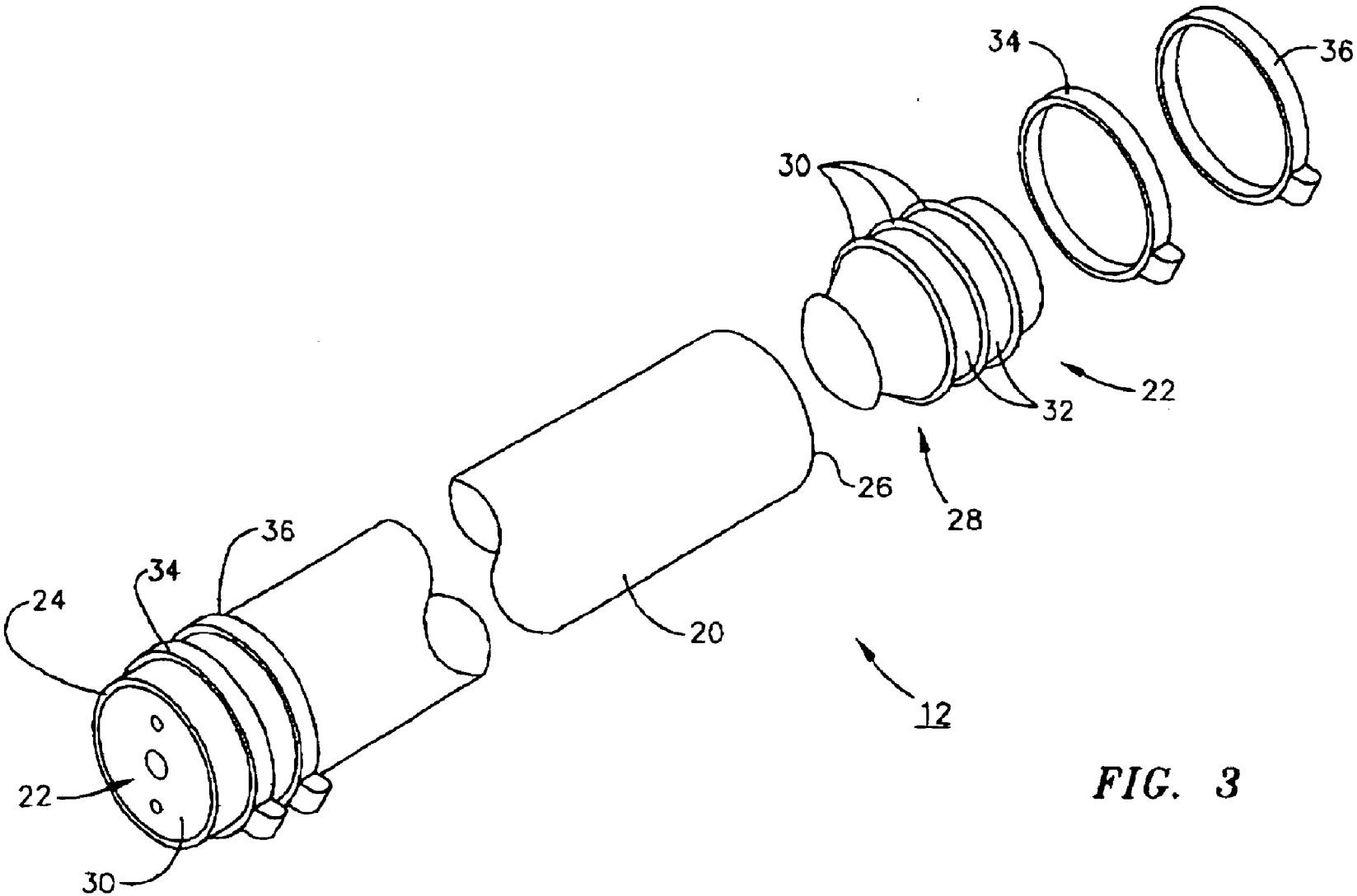
FIG. 3 is an exploded view of one embodiment of a liquid containing resistor element in accordance with the present invention.

As shown in FIG. 3, each of resistor elements 12 comprises an insulating tube 20 containing a resistive fluid as described below and having an electrode 22 inserted into opposing ends 24 and 26 thereof. Electrode 22 preferably has a preferably mushroom shaped end 28 for ease of insertion into end 26 of insulating tube 20 and a flat end 30 for contacting an electrode plate for electrical connection with the balance of the resistor system as described below. As will be apparent to the skilled artisan, mushroom shaped end 28 could be of any suitable shape that allows for insertion of end 28 into insulating tube 20. According to the embodiment depicted in FIGS. 3 and 4, electrodes 22 are provided with peripheral ridges 30 that provide for a tight interference fit when electrode 22 is inserted into ends 24 and 26 and also provide depressions 32 into which hose clamps 34 and 36 can rest as hose clamps 34 and 36 are tightened in the conventional fashion, and insulated tube 20 deforms under the peripheral pressure of hose clamps 34 and 36. Clearly, specific alternative structures for electrodes 22 can be provided without departing from the spirit and scope of the invention. While insulating tubes 20 can be fabricated from a wide variety of materials, it is preferred that they be of Tygon® or some similar highly insulating and heat resistant material.

Figure 4:
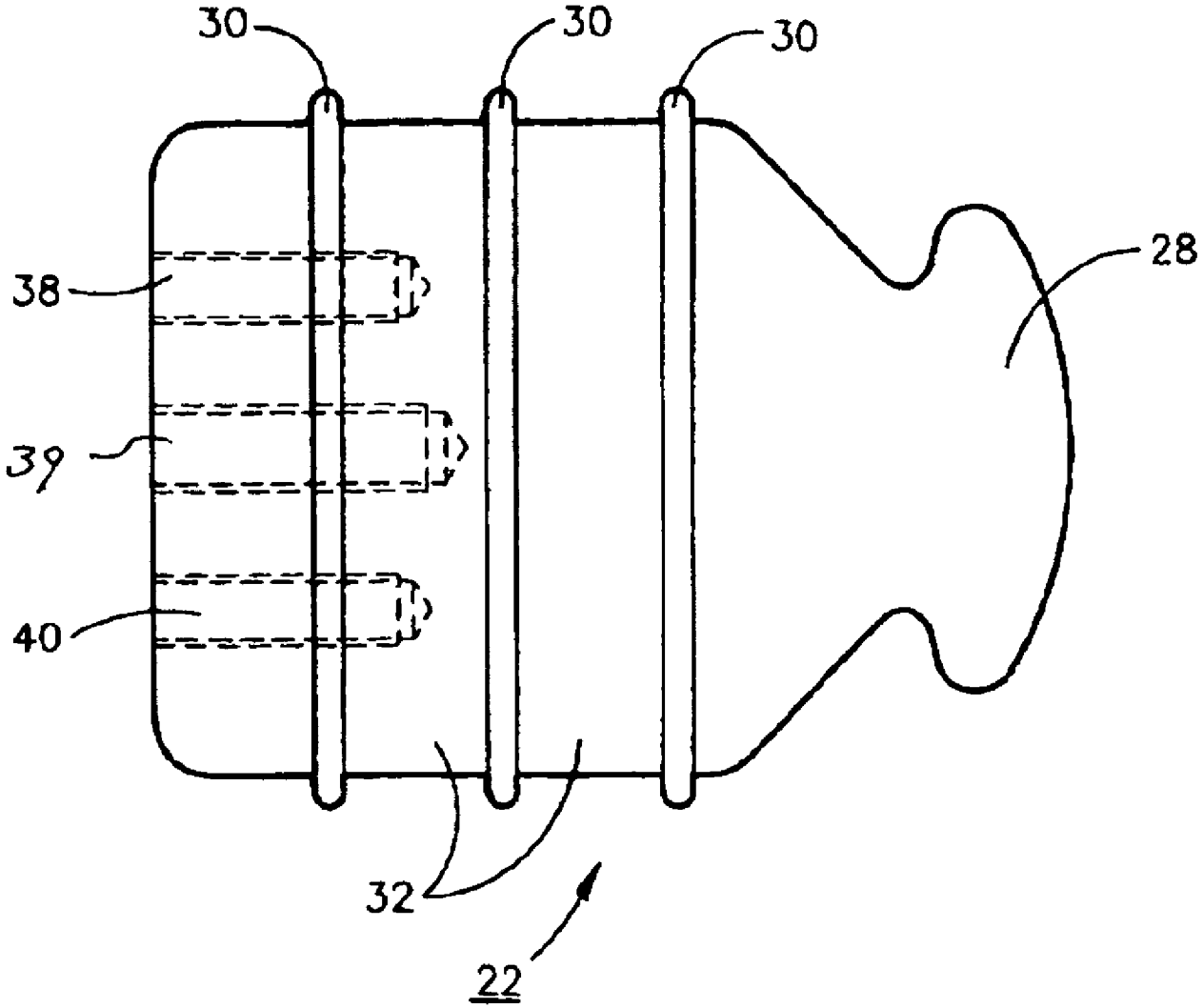
FIG. 4 is a partially phantom view of the electrode portion of the resistor array of the present invention.

As best seen in FIG. 4, electrode 22 in addition to the elements thereof previously described also incorporates apertures 38, 39 and 40 that receive bolts 42 that serve to attach resistor electrodes 22 and consequently resistive fluid containing resistor elements 12 to end plates 13 and 15. The insertion and tightening of bolts 42 through apertures in end plates 13 and 15 into apertures 38 and 40 provide that the entire resistor array is securely and electrically connectively joined together as a unitary structure comprising resistor elements 12 and end plates 13 and 15 that, in turn, are attached to corona rings 18. While three bolt apertures 38, 39 and 40 are depicted in FIG. 4, it will be readily apparent that two or even a single bolt aperture and bolt 42 can be provided so long as electrodes 22 as sufficiently tightly attached to end plates 13 and 15 as to provide electrical contact between electrodes 22 and end plates 13 and 15. High voltage isolation support rods 21 are preferably used to provide additional structural support to resistor array 10 as insulated tubes 20 may not provide sufficient structural strength to support the entire structure. Support rods 21 are, of course, joined to end plates 13 and 15 using suitable insulating connectors in a fashion well known to those skilled in the art of constructing such devices. A suitable high voltage power supply 44 is connected to resistor array via high voltage cable 46 and ground return cable 48. The foregoing comprises a description of the essential elements of resistor array 10.

In many applications, it may be necessary that resistor array 10 be moved from location to location. In such an instance it may be desirable to equip resistor array 10 with a suitable carriage arrangement and that feature is now described. Carriage 17 comprises a platform 52 equipped with casters 54 and carriage 17 is attached to resistor array 10 through the mechanism of a plurality of legs 56 that are attached to and insulated from bottom end plate 15, for example through the use of insulating structures 58, or other similarly insulated structures well known in the art. When thus equipped with a carriage, resistor array 10 can be moved with relatively little effort to whatever location may require its use.

An obviously critical element of the resistor array 10 of the present invention is, of course, the resistive fluid contained within resistor elements 12. According to a preferred embodiment of the present invention, resistive fluid contained within resistor elements 12 comprises an aqueous solution of copper sulfate. As is apparent, a wide variety of other resistive fluids could be used as the resistive fluid in resistor array 10. The value of resistor array 10 is determined by both the number of resistor elements and the concentration of copper sulfate or other appropriate resistive fluid in a polar solvent such as water. In the case of a copper sulfate or similar resistive solution, the maximum resistive value (~a few meg-ohms) will be obtained when pure distilled water is used. The lowest resistive values (~a few hundred ohms) will be obtained by having the maximum amount of copper sulfate or other solute that can be dissolved in water. Although there are formulae for determining the end value of a resistor array constructed given a discreet insulating tube length, tubing cross section, number of resistive elements and the resistivity of the solution (such formulae being well known to those skilled in the art of designing fluid resistors) such formulae depend to some extent on the quality of the distilled water or other solvent used and the purity of the solute, in the preferred case copper sulfate or other suitable solute. Through experience, it has been found that simply preparing an approximately appropriate resistive solution, measuring its resistivity with a meter and then adjusting the concentration of the solute in the solution upwards (to decrease resistivity) or downwards (to increase resistivity) works extremely well for determining the proper solution given the materials being used and the design of resistor 10, i.e. the number of resistor elements used. A high voltage Megger insulation test meter has been found entirely adequate to measure the resistance of such fluids during the fabrication process. Since the design of the resistor array as described above comprises several resistors in parallel to distribute the current load, the resistive value of all resistors should be within a maximum range of about 20% of each other's value (a limit of 10% above or below the desired value). This prevents one resistor element from carrying too large a share of the current and overheating. A resistor array comprising 12 resistor elements about 33 inches long has been found to be entirely adequate for purposes of a 600,000 volt load at low amperage as described above.

Fabrication of the resistor array 10 of the present invention is accomplished by first inserting one of the electrodes 22 into the first end of one of the insulating tubes 20, applying hose clamps 34 and 36 about the periphery of insulating tube 20 such that hose clamps 34 and 36 depress a portion of insulating tubing 20 into recesses 32 to close the first end of the insulating tube 20. Secondly, filling the thus formed closed insulating tube 20 with a suitable resistive solution prepared as described above and repeating the insulating tube closing operation by insertion of an electrode 22 into the second end of the tubing and applying hose clamps 34 and 36 as just described. A plurality of resistor elements 12 adequate in number for the particular application being designed is prepared and the resistor elements connected to end plates 13 and 15 by the insertion of bolts 42 into through apertures in end plates 13 and 15 and into apertures 38 and 40 in electrodes 22. High voltage isolation support rods 21 are similarly bolted into place between end plates 13 and 15. If desired, the thus assembled resistor array can then be mounted to a carriage as described hereinabove.

There has thus been described a high voltage resistor that is readily modifiable to meet a wide variety of resistor applications and is readily repairable in case of physical damage due to electrical overload or failure or simple mishandling.

While high voltage resistor 10 of the present invention has been described and shown in the Figures as being circular as this is obviously the most compact and efficient design for ease movement and electrical protection, it will be apparent to the skilled artisan that other somewhat less efficient designs ranging from rectangular (harder to protect from arcing) to oval may also be constructed without departing from the spirit and scope of the invention. What ever the design, it is very important that no sharp edges, burrs or the like be resent on the surface of any of the conductive elements as such defects can result in unwanted and even dangerous sites for the occurrence of arcing. Similarly, all surfaces should be clean and free of potentially conductive oils, greases and the like to prevent unwanted arcing during use.

As the invention has been described, it will be apparent to those skilled in the art that the same may be varied in many ways without departing from the spirit and scope of the invention. Any and all such modifications are intended to be included within the scope of the appended claims.

What is claimed is:

1. A high voltage resistor comprising:

a) an array of a plurality resistor elements having first and second ends and each of said resistor elements comprising:

i) an insulating tube containing a resistive fluid and having an electrode inserted into each end thereof;

b) end plates at each of said first and second ends attached to said resistor elements; and c) about the circumference of each of said end plates, a corona reduction ring.

2. The high voltage resistor of claim 1 further including high voltage isolation and support rods between said end plates.

3. The high voltage resistor of claim 1 wherein said electrodes are of stainless steel.

4. The high voltage resistor of claim 1 wherein said electrodes have first and second ends, said first end is mushroom shaped for ease of insertion into said insulating tubes and said second end is flat.

5. The high voltage resistor of claim 1 wherein said electrodes include at least two peripheral ridges that define a recess therebetween, said insulated tube has a periphery and said electrodes are retained in said insulated tube by means of at least one hose clamp about said periphery and said electrode in the region of said recess.

6. The high voltage resistor of claim 1 wherein said electrodes each have a flat end that engages one of said end plates, said end plates include end plate apertures, said flat ends include electrode apertures and bolts inserted through said end plate apertures into said electrode apertures such that said bolts attach said resistor elements to said end plates.

7. The high voltage resistor of claim 1 wherein said resistive solution comprises a solution of copper sulfate.

8. A high voltage resistor comprising:

a) an array of a plurality resistor elements having first and second ends and each of said resistor elements comprising:

i) an insulating tube having first and second ends and containing a resistive fluid;

ii) stainless steel electrodes having a mushroom shaped first ends inserted into each of said first and second insulating tube ends, a flat end, bolt apertures in said flat end and at least two peripheral ridges defining a recess therebetween;

iii) at least one hose clamp about each of said first and second ends of said insulating tube and each of said stainless steel electrodes retaining said electrodes in said first and second ends of said insulating tube;

iv) end plates at each of said first and second ends having end plate apertures therein attached to said resistor elements by bolts that penetrate said endplate apertures and fasten in said electrode apertures; and v)about the circumference of each of said end plates, a corona reduction ring.

9. The high voltage resistor of claim 1 further including a carriage to which said high voltage resistor is attached.

10. The high voltage resistor of claim 8 further including a carriage to which said high voltage resistor is attached.

* * * * *